US012606919B2

(12) United States Patent
Kibria et al.

(10) Patent No.: US 12,606,919 B2
(45) Date of Patent: Apr. 21, 2026

(54) MULTI-METAL ELECTROCATALYTIC SYSTEM FOR METHANE OXIDATION

(71) Applicant: UTI Limited Partnership, Calgary (CA)

(72) Inventors: Md Golam Kibria, Calgary (CA); Tareq Ali Al-Attas, Calgary (CA); Mohd Adnan Khan, Calgary (CA); Nael Yasri, Calgary (CA)

(73) Assignee: UTI Limited Partnership, Vancouver (CA)

( * ) Notice: Subject to any disclaimer, the term of this patent is extended or adjusted under 35 U.S.C. 154(b) by 53 days.

(21) Appl. No.: 18/681,478

(22) PCT Filed: Aug. 3, 2022

(86) PCT No.: PCT/CA2022/051184
§ 371 (c)(1),
(2) Date: Feb. 5, 2024

(87) PCT Pub. No.: WO2023/010214
PCT Pub. Date: Feb. 9, 2023

(65) Prior Publication Data

US 2024/0344211 A1 Oct. 17, 2024

Related U.S. Application Data

(60) Provisional application No. 63/229,188, filed on Aug. 4, 2021.

(51) Int. Cl.
*C25B 3/07* (2021.01)
*C25B 3/23* (2021.01)
(Continued)

(52) U.S. Cl.
CPC ..... *C25B 3/23* (2021.01); *C25B 3/07* (2021.01); *C25B 9/17* (2021.01); *C25B 11/031* (2021.01);
(Continued)

(58) Field of Classification Search
CPC ..... C25B 3/23; C25B 3/07
(Continued)

(56) References Cited

U.S. PATENT DOCUMENTS

2006/0235088 A1* 10/2006 Olah ..... C10L 1/023 518/702
2015/0129430 A1* 5/2015 Fan ..... C25B 13/02 205/450
2022/0228278 A1* 7/2022 Moon ..... C25B 11/093

OTHER PUBLICATIONS

Xia et al., "Electrospun Porous CuFe2O4 Nanotubes on Nickel Foam for Nonenzymatic Voltammetric Determination of Glucose and Hydrogen Peroxide," Journal of Alloys and Compounds (Mar. 30, 2018), vol. 739, pp. 764-770. (Year: 2018).*
(Continued)

*Primary Examiner* — Edna Wong
(74) *Attorney, Agent, or Firm* — FisherBroyles LLP; Anthony J DoVale; Scott Nielson

(57) ABSTRACT

Methods and cells are provided for electrochemically oxidizing methane to formate, in which methane supplied to an alkaline aqueous anolyte medium comprising hydroperoxyl anions is brought into contact with an oxidation catalyst anode. The oxidation catalyst may include CuFe oxide catalytic centres supported on a nickel substrate. An anodic current supplied to the oxidation catalyst in the anolyte medium electrolytically oxidizes methane to formate.

7 Claims, 4 Drawing Sheets

(51) Int. Cl.
*C25B 9/17* (2021.01)
*C25B 11/031* (2021.01)
*C25B 11/052* (2021.01)
*C25B 11/061* (2021.01)
*C25B 11/077* (2021.01)

(52) U.S. Cl.
CPC ..... *C25B 11/052* (2021.01); *C25B 11/061* (2021.01); *C25B 11/077* (2021.01)

(58) Field of Classification Search
USPC ..... 205/440
See application file for complete search history.

(56) References Cited

OTHER PUBLICATIONS

Wu et al., "Proton Conduction and Fuel Cell Using the CuFe-Oxide Mineral Composite Based on CuFeO2 Structure," ACS Applied Energy Materials (Feb. 26, 2018), vol. 1, No. 2, pp. 580-588. (Year: 2018).*
Amenomiya, Y., Birss, V. I., Goledzinowski, M., Galuszka, J. & Sanger, A. R. Conversion of Methane by Oxidative Coupling. Catal. Rev. 32, 163-227 (1990).
Bagherzadeh Mostaghimi, A. H., Al-Attas, T. A., Kibria, M. G. & Siahrostami, S. A review on electrocatalytic oxidation of methane to oxygenates. J. Mater. Chem. A 8, 15575-15590 (2020).
Ding, K. et al. Pt-Ni bimetallic composite nanocatalysts prepared by using multi-walled carbon nanotubes as reductants for ethanol oxidation reaction. Int. J. Hydrogen Energy 39, 17622-17633 (2014).
Faheem, M., Jiang, X., Wang, L. & Shen, J. Synthesis of Cu2O—CuFe2O4 microparticles from Fenton sludge and its application in the Fenton process: The key role of Cu2O in the catalytic degradation of phenol. RSC Adv. 8, 5740-5748 (2018).
Han, G. F. et al. Building and identifying highly active oxygenated groups in carbon materials for oxygen reduction to H2O2. Nat. Commun. 11, (2020).
Inamdar, A. I. et al. A Robust Nonprecious CuFe Composite as a Highly Efficient Bifunctional Catalyst for Overall Electrochemical Water Splitting. Small 16, (2020).
Indra, A. et al. Unification of catalytic water oxidation and oxygen reduction reactions: Amorphous beat crystalline cobalt iron oxides. J. Am. Chem. Soc. 136, 17530-17536 (2014).
Karthikeyan, S. et al. Cu and Fe oxides dispersed on SBA-15: A Fenton type bimetallic catalyst for N,N-diethyl-p-phenyl diamine degradation. Appl. Catal. B Environ. 199, 323-330 (2016).
Kim, H. W. et al. Efficient hydrogen peroxide generation using reduced graphene oxide-based oxygen reduction electrocatalysts. Nat. Catal. 1, 282-290 (2018).
Le Formal, F. et al. Rate Law Analysis of Water Oxidation on a Hematite Surface. J. Am. Chem. Soc. 137, 6629-6637 (2015).
International Search report issued in International Application No. PCT/CA2022/051184 on Oct. 22, 2022.
Written opinion issued in International Application No. PCT/CA2022/051184 on Oct. 22, 2022.
Sa, Y. J., Kim, J. H. & Joo, S. H. Active Edge-Site-Rich Carbon Nanocatalysts with Enhanced Electron Transfer for Efficient Electrochemical Hydrogen Peroxide Production. Angew. Chemie—Int. Ed. 58, 1100-1105 (2019).
Sahasrabudhe, A., Dixit, H., Majee, R. & Bhattacharyya, S. Value added transformation of ubiquitous substrates into highly efficient and flexible electrodes for water splitting. Nat. Commun. 9, (2018).
Shah et al., A Catalytic Oxidation of Methane to Oxygenated Products: Recent Advancements and Prospects for Electrocatalytic and Photocatalytic Conversion at Low Temperatures, Adv. Sci. 2020, 7, 2001946.
Szécsényi, Á., Li, G., Gascon, J. & Pidko, E. A. Mechanistic Complexity of Methane Oxidation with H2O2 by Single-Site Fe/ZSM-5 Catalyst. ACS Catal. 8, 7961-7972 (2018).
Takashima, T., Yamaguchi, A., Hashimoto, K., Irie, H. & Nakamura, R. In situ UV-vis Absorption Spectra of Intermediate Species for Oxygen-Evolution Reaction on the Surface of MnO2 in Neutral and Alkaline Media. Electrochemistry 82, 325-327 (2014).
Yamashita, T. & Hayes, P. Analysis of XPS spectra of Fe 2+ and Fe 3+ ions in oxide materials. Appl. Surf. Sci. 254, 2441-2449 (2008).
Yi, Y. et al. Electrochemical corrosion of a glassy carbon electrode. Catal. Today 295, 32-40 (2017).
Akbar et al., A Robust Nonprecious CuFe Composite as a Highly Efficient Bifunctional Catalyst for Overall Electrochemical Water Splitting, Nano Micro Small, vol. 16, Issue2, Jan. 16, 2020.
Assumpção, M. H. M. T. et al. A comparative study of the electrogeneration of hydrogen peroxide using Vulcan and Printex carbon supports. Carbon N. Y. 49, 2842-2851 (2011).
Barros, W. R. P., Ereno, T., Tavares, A. C. & Lanza, M. R. V. In Situ Electrochemical Generation of Hydrogen Peroxide in Alkaline Aqueous Solution by using an Unmodified Gas Diffusion Electrode. ChemElectroChem 2, 714-719 (2015).
Brillas, E., Alcaide, F. & Cabot, P. L. A small-scale flow alkaline fuel cell for on-site production of hydrogen peroxide. Electrochim. Acta 48, 331-340 (2002).
Chen, J. Y. C. et al. Operando Analysis of NiFe and Fe Oxyhydroxide Electrocatalysts for Water Oxidation: Detection of Fe4+ by Mössbauer Spectroscopy. J. Am. Chem. Soc. 137, 15090-15093 (2015).
Ellison, M. D., Crotty, M. J., Koh, D., Spray, R. L. & Tate, K. E. Adsorption of NH 3 and NO 2 on single-walled carbon nanotubes. J. Phys. Chem. B 108, 7938-7943 (2004).
Guo, Y. et al. Electrocatalytic reduction of CO2 to CO with 100% faradaic efficiency by using pyrolyzed zeolitic imidazolate frameworks supported on carbon nanotube networks. J. Mater. Chem. A 5, 24867-24873 (2017).
Kamiya, K., Kuwabara, A., Harada, T. & Nakanishi, S. Electrochemical Formation of Fe(IV)=O Derived from H2O2 on a Hematite Electrode as an Active Catalytic Site for Selective Hydrocarbon Oxidation Reactions. ChemPhysChem 20, 648-650 (2019).
Klahr, B. & Hamann, T. Water oxidation on hematite photoelectrodes: Insight into the nature of surface states through in situ spectroelectrochemistry. J. Phys. Chem. C 118, 10393-10399 (2014).
Li, L. et al. Tailoring Selectivity of Electrochemical Hydrogen Peroxide Generation by Tunable Pyrrolic-Nitrogen-Carbon. Adv. Energy Mater. 10, 1-10 (2020).
Liu, Y. et al. Insights into the interfacial carrier behaviour of copper ferrite (CuFe 2 O 4 ) photoanodes for solar water oxidation. J. Mater. Chem. A 7, 1669-1677 (2019).
Lu, Z. et al. High-efficiency oxygen reduction to hydrogen peroxide catalysed by oxidized carbon materials. Nat. Catal. 1, 156-162 (2018).
Merle, G., Wessling, M. & Nijmeijer, K. Anion exchange membranes for alkaline fuel cells: A review. J. Memb. Sci. 377, 1-35 (2011).
Nagaiah, T. C., Kundu, S., Bron, M., Muhler, M. & Schuhmann, W. Nitrogen-doped carbon nanotubes as a cathode catalyst for the oxygen reduction reaction in alkaline medium. Electrochem. commun. 12, 338-341 (2010).
Salvatore, D. A. et al. Designing anion exchange membranes for CO2 electrolysers. Nat. Energy, vol. 6, Apr. 2021, 339-348.
Takashima, T., Ishikawa, K. & Irie, H. Detection of Intermediate Species in Oxygen Evolution on Hematite Electrodes Using Spectroelectrochemical Measurements. J. Phys. Chem. C 120, 24827-24834 (2016).
Wang, D. et al. In Situ X-ray Absorption Near-Edge Structure Study of Advanced NiFe(OH)x Electrocatalyst on Carbon Paper for Water Oxidation. J. Phys. Chem. C 119, 19573-19583 (2015).
Wang, V. C. C. et al. Alkane Oxidation: Methane Monooxygenases, Related Enzymes, and Their Biomimetics. Chem. Rev. 117, 8574-8621 (2017).
Weissmann, M., Baranton, S., Clacens, J. M. & Coutanceau, C. Modification of hydrophobic/hydrophilic properties of Vulcan XC72 carbon powder by grafting of trifluoromethylphenyl and phenylsulfonic acid groups. Carbon N. Y. 48, 2755-2764 (2010).
Xia, C., Yoon, J., Kim, T. & Wang, H. Recommended practice to report selectivity in. Nat. Catal. 3, 605-607 (2020).

(56) References Cited

OTHER PUBLICATIONS

Yuan, S. et al. Conversion of Methane into Liquid Fuels-Bridging Thermal Catalysis with Electrocatalysis. Adv. Energy Mater. 10, 1-19 (2020).
Zandi, O. & Hamann, T. W. Determination of photoelectrochemical water oxidation intermediates on haematite electrode surfaces using operando infrared spectroscopy. Nat. Chem. 8, 778-783 (2016).

* cited by examiner

MULTI-METAL ELECTROCATALYTIC SYSTEM FOR METHANE OXIDATION

FIELD

Innovations are disclosed in the field of oxidative electrochemical catalysis.

BACKGROUND

For decades, natural gas lagged coal and oil as an energy source, but today its consumption is growing rapidly as countries seek to lower greenhouse gas emissions by displacing coal for heating and power generation. The recent discoveries of vast shale gas reserves in the United States and widespread use of hydraulic fracturing, has seen natural gas prices decrease and today it supplies ~22% of the global energy need.[1] In its 2020 report, the International Energy Agency (IEA) projected global demand for natural gas to increase by 29% by 2040 and it would be the largest energy source among fossil fuels.[2] In addition, the main component of natural gas i.e., methane ($CH_4$) is a well-established and widely available feedstock to produce several important commodity chemicals such as methanol, hydrogen, ammonia, and formaldehyde. Typical valorization of $CH_4$ takes place with a combination of steam methane reforming and Fischer-Tropsch synthesis. These are highly endothermic processes requiring high temperatures (700° C.-1100° C.), pressures (10-40 bars) and suffer from a tradeoff between conversion and selectivity. Moreover, they are highly capital-intensive processes, requiring many unit operations and centralized infrastructure, thus hindering their implementation on a small scale. Therefore, it seems of great importance to developing a low-cost sustainable method for the direct partial oxidization of $CH_4$ to useful chemicals and fuels under ambient conditions.

In this context, electrochemical partial oxidation of $CH_4$ to oxygenates such as methanol ($CH_3OH$) and formic acid (HCOOH) is particularly attractive. The electrochemical conversion of $CH_4$ under ambient conditions also offers a route to store renewable electricity addressing a major challenge of intermittency. The ability to control the potential to alter the selectivity of the reaction is another appealing factor to develop an electrochemical route for partial oxidation of $CH_4$ to oxygenates. Since electrochemical devices are highly modular, and because the productivity scales directly with electrode size and current, an electrochemical route can provide an efficient and cost-effective solution that can be deployed in both large-scale industries and small-scale remote applications (such as those needed in remote oil fields).

There have been attempts to develop catalysts for electrochemical $CH_4$ oxidation using metal/metal-oxides in various reaction conditions, however with limited success. The reported current densities or reaction rates are low ($\mu A\ cm^{-2}$ to 1 $mA\ cm^{-2}$), without any analysis of the Faradaic efficiency (FE) and reaction mechanism. A major difficulty arises due to the stable non-polar tetrahedral molecular geometry of $CH_4$ and high C—H bond energy ($\Delta H_{C-H}$= 439.3 $KJ\ mol^{-1}$). Once this high activation energy for C—H bond dissociation is attained, it is difficult to control the partial oxidation to oxygenates, which are intermediate products, and avoid the terminal and more thermodynamically favourable pathway of $CO_2$ production.[3] The competitive oxygen evolution reaction (OER) poses additional challenges to attain high selectivity towards $CH_4$ oxidation products. Conventional alkaline water electrolysers operate at room temperature, with the hydroxide ion ($HO^-$) generally functioning as the oxidant. Nevertheless, $HO^-$ has a negligible activity for protons abstraction from $CH_4$ at mild conditions.[4] Attempts for electrochemical $CH_4$ oxidation have also been made by utilizing high-temperature oxygen-ion conducting solid oxide electrolysis cells (SOECs). However, due to the use of high temperature, the reported selectivity towards oxygenates is negligible.

SUMMARY

Catalytic systems are disclosed for electrochemical $CH_4$ oxidation to formate, including systems that function under ambient conditions. Operando spectroelectrochemistry studies reveal that the $Fe^{IV}$=O species are active sites for electrochemical $CH_4$ oxidation. Although electrochemical oxidation of $Fe^{III}$ to $Fe^{IV}$ can be achieved at high potentials (≥1.4 V versus reversible hydrogen electrode, $V_{RHE}$), high overpotentials lead to overoxidation of $CH_4$ to $CO_2$. Therefore, we demonstrate herein the use of reactive oxygen species (e.g., generated via partial electrooxidation of $H_2O_2$ on Ni) to mediate $Fe^{III}$ oxidation to $Fe^{IV}$ at lower overpotential, suppressing unwanted overoxidation. Furthermore, we reveal the key role of Cu as a co-catalyst in preventing the complete oxidation of $CH_4$ to $CO_2$ by increasing the activation energy of the intermediate step. A CuFeNi catalyst is accordingly provided that exhibits electrochemical $CH_4$ oxidation to formate at high current density (32 $mA\ cm^{-2}$), Faradaic efficiency (42%) and liquid oxygenate selectivity (100%) using a low applied potential (0.9 $V_{RHE}$).

Methods for using electrolytic cells are accordingly provided for electrochemically oxidizing methane to formate. The methods involve providing a methane supply to an alkaline aqueous anolyte medium including hydroperoxyl anions, where the anolyte medium is in contact with an oxidation catalyst anode, where the oxidation catalyst anode includes CuFe oxide catalytic centres supported on a nickel substrate; and, supplying an anodic current to the oxidation catalyst anode in the anolyte medium, to electrolytically oxidize methane to formate in an anodic oxidation reaction.

Accordingly, one general aspect of the present methods and electrolytic cells involves the use of an anodic CuFeNi oxidation catalyst to electrochemically oxidize methane to formate, for example where the nickel substrate is a nickel foam substrate.

DETAILED DESCRIPTION

Figure 5:
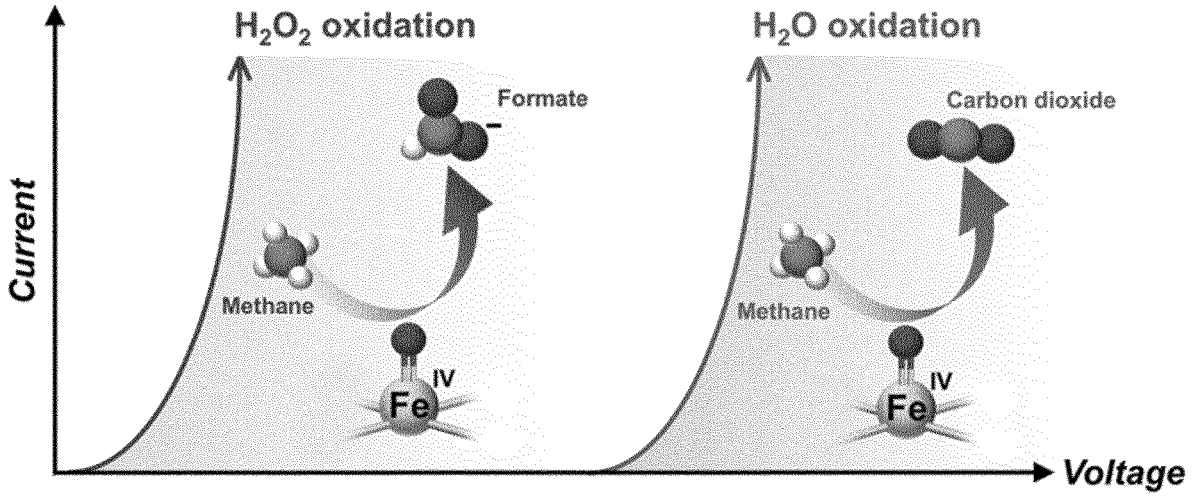
FIG. 5 is a schematic illustration of processes disclosed herein.

Selective partial oxidation of methane to liquid oxygenates has been a long-sought goal, due to the intrinsic chemical inertness of its C—H bonds. With the continuous reduction in renewable electricity prices, the electrochemical partial oxidation of methane is gaining momentum globally. Inspired by the catalytic sites in cytochrome P450 and soluble methane monooxygenase (sMMO) metalloenzymes, here we disclose a highly active multi-metal CuFeNi electrocatalyst for selective electrochemical methane oxidation reaction ($eCH_4OR$) to formate at room temperature. Mechanistic studies using operando spectroelectrochemistry measurements revealed the synergistic effect of nickel, iron, and copper to selectively oxidize $CH_4$. Specifically, the analysis revealed the presence of high valent $Fe^{IV}$ as the active site for $CH_4$ oxidation, attained by the reactive oxygen species generated during the partial oxidation $H_2O_2$ at low overpotentials compared to water oxidation reaction (OER) on nickel. Furthermore, the critical role of copper in preventing the overoxidation of valuable oxygenates to $CO_2$ is disclosed. We achieved Faradaic efficiencies of ~42% and liquid product selectivity of 100% at current densities of 32 mA $cm^{-2}$ using a low applied potential of 0.9 V versus reversible hydrogen electrode. The system is schematically illustrated in FIG. 5, and described in detail in the following Examples.

EXAMPLES

Electrochemical $CH_4$ Oxidation Reaction ($eCH_4OR$).

Figure 1:
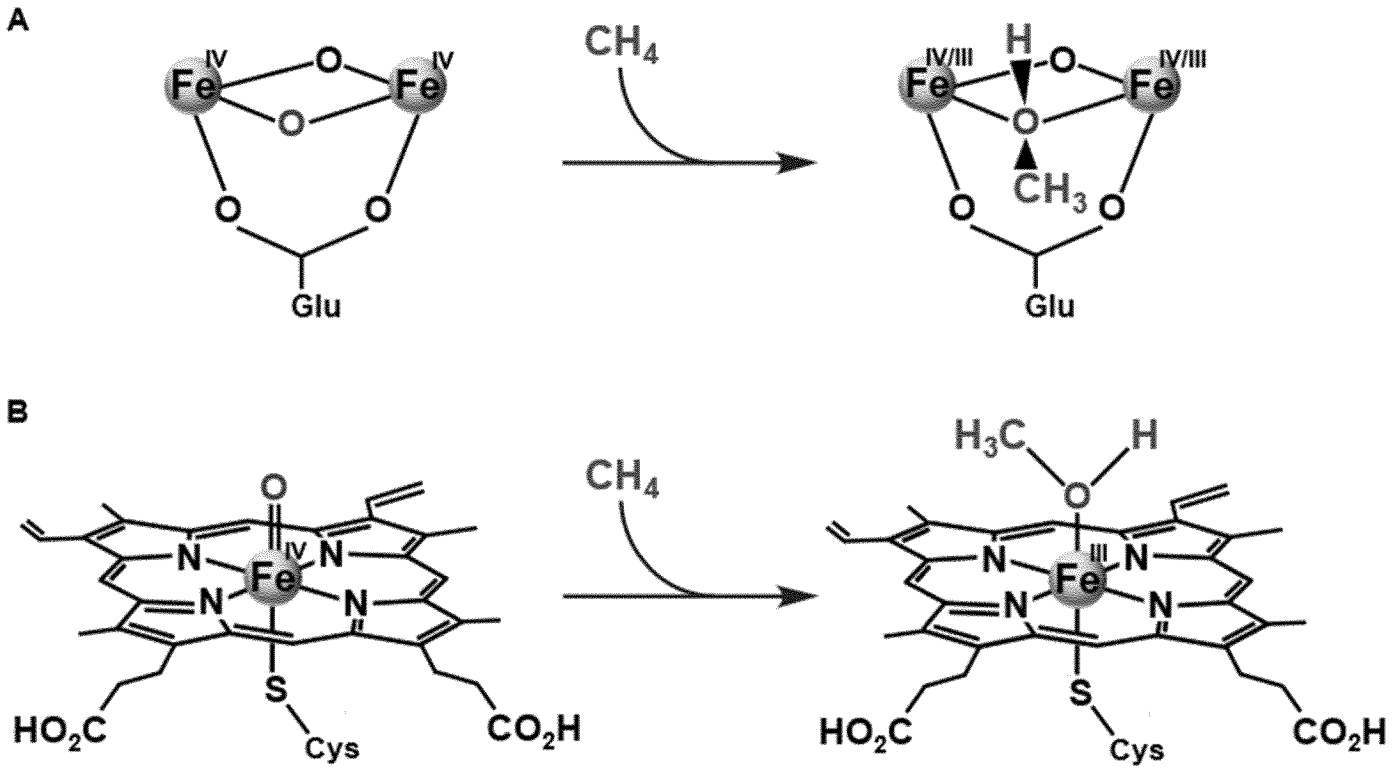
FIG. 1 Biological examples for $CH_4$ hydroxylation. (A) Diiron diamond-core structure of the intermediate Q proposed in sMMO and a proposed $CH_4$ hydroxylation reaction via a radical rebound mechanism. Glu, glutamate amino-acid residue. (B) Heme structure of the intermediate I proposed in cytochrome P450 and a proposed $CH_4$ hydroxylation reaction. Cys, cysteine thiolate ligand.
Figure 2:
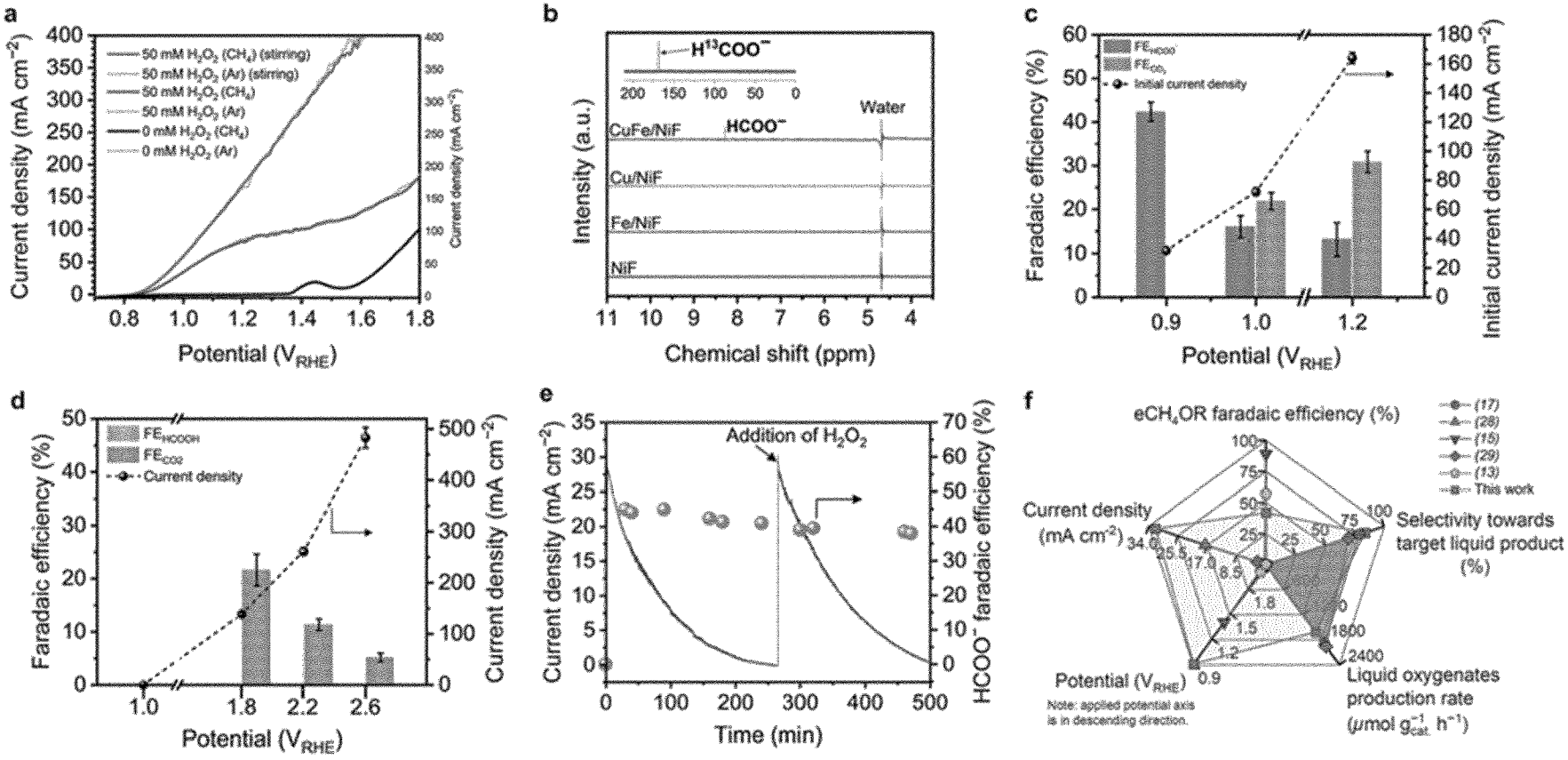
FIG. 2 Electrochemical $CH_4$ oxidation reaction, $eCH_4OR$. (A) Linear sweep voltammetry in H-type cell using CuFe/NiF electrode in 1.0 M KOH with and without the addition of 50 mM $H_2O_2$. (B) $^1H$ NMR spectra after $CH_4$ electrolysis performed using NiF, Fe/NiF, Cu/NIF, and CuFe/NiF electrodes at a constant voltage of 1.0 $V_{RHE}$ for 1 hour in 1.0 M KOH with 50 mM $H_2O_2$ (inset: $^{13}C$ NMR spectrum of $^{13}CH_4$ electrolysis performed using the CuFe/NiF electrode at a constant voltage of 1.0 $V_{RHE}$ for 1 hour in 1.0 M KOH with 50 mM $H_2O_2$). (C) $eCH_4OR$ products faradaic efficiencies and corresponding current densities obtained at different applied potentials on the CuFe/NiF in 1.0 M KOH with 50 mM $H_2O_2$. (D) $eCH_4OR$ products faradaic efficiencies and corresponding current densities obtained at different applied potentials on the CuFe/NiF in 1 M KOH (without the addition of $H_2O_2$). (E) Chronoamperometry of CuFe/NiF at 0.9 $V_{RHE}$ showing the consumption of $H_2O_2$ after 260 min and the effect of adding the same amount of $H_2O_2$ in restoring the current. (F) Radar chart showing a comparison of $eCH_4OR$ faradaic efficiency, selectivity towards the target product, liquid oxygenates production rate, applied potential, and current density against selected best reports from the literature.

Electrochemical oxidations were performed in a 3-electrode H-type cell, in an alkaline environment (1.0 M KOH) using a hydrothermally grown CuFe oxide on nickel foam, denoted as CuFe/NiF (synthesis procedure is discussed in the Supplementary Information). FIG. 2A shows the linear sweep voltammetry (LSV) curves under a continuous purge of Ar and $CH_4$ in the anolyte, with and without the addition of $H_2O_2$. Regardless of the purge gas used, the onset potential of the oxygen evolution reaction (OER) in the absence of $H_2O_2$ is seen at high anodic potentials (>1.5 $V_{RHE}$), triggered by the transition of β-$Ni(OH)_2$ to β-NiOOH as seen by the peak centred at 1.42 $V_{RHE}$. With the addition of 50 mM $H_2O_2$, the anodic current starts to increase at an onset potential of ~0.8 $V_{RHE}$, i.e., at an overpotential of ~0.107 V, as the standard oxidation potential of $H_2O_2$ is 0.693 $V_{RHE}$ ($H_2O_{2(aq)} \rightarrow O_{2(g)} + 2H^+_{(aq)} + 2e^-$). The anodic current increases gradually and at higher voltages emerges as combined oxidation current from $H_2O_2$ oxidation and OER. The two-step increase in current density is due to the decrease of the alkalinity at the electrode surface because of the presence of protons released during the potential sweep.[6] This behaviour was verified when the reaction was performed under stirring conditions in which the current continuously increased. It is worth mentioning that since the pH of the electrolyte is above 9, $H_2O_2$ exists mainly as $HOO^-$ (hydroperoxyl anion), which will be referred to interchangeably herein.

The current observed at a low potential regime (~0.8-1.5 $V_{RHE}$) is driven mainly from the $H_2O_2$ oxidation on the nickel surface. This was confirmed due to the negligible oxidation current (<1 mA $cm^{-2}$) from CuFe catalysts which were grown on titanium foam (denoted as CuFe/TiF) following the same synthesis method as the CuFe/NiF electrode. Interestingly the current density with and without (i.e., Ar purge) purging $CH_4$ did not change (FIG. 2A), however, upon analysing the electrolyte with 1H NMR (FIG. 2B), after 60 min of reaction under chronoamperometric conditions, indicated formate production. Chronoamperometry tests using isotopically labelled $^{13}CH_4$ and the $^{13}C$ NMR analysis, as shown in the inset of FIG. 2B, further confirmed the $CH_4$ to be the carbon source. Following that, we carried out control experiments at the same condition using NiF, Fe/NiF and Cu/NiF as catalysts which revealed that only the CuFe/NiF catalyst was able to oxidize $CH_4$ to formate (FIG. 2B), indicating the synergistic effect of Ni, Fe and Cu in selective partial oxidation of $CH_4$ to formate. It is important to highlight that while NiF and Cu/NiF did not produce any oxidation products (formate or $CO_2$), the Fe/NiF catalyst produced $CO_2$ indicating electrochemical oxidation of $CH_4$ (see SI). However, unlike the CuFe/NiF catalyst, the LSV curves and chronoamperometry measurements using Fe/NIF, revealed higher current density when the purge gas of the anolyte is switched from Ar to $CH_4$.

We then carried out chronoamperometry tests using the CuFe/NiF electrode with the addition of 50 mM $H_2O_2$, at different voltages, (FIG. 2C). Irrespective of the voltage applied, formate was the only liquid product detected and $O_2$ was the only gas product that comes from $H_2O_2$ oxidation as the applied voltages were below those needed for water oxidation. Since the reaction was done in alkaline conditions, it was assumed that any $CO_2$ produced would be captured in the form of carbonate ($CO_3^{2-}$). The quantification of $CO_3^{2-}$ was performed using the total alkalinity method which revealed that the total FE for $CH_4$ oxidation ($HCO^- + CO_2$) was very similar (~50%) irrespective of the applied voltages. We believe this behaviour is due to the limited availability of $CH_4$ in the electrolyte because of its low solubility (23 mg $L^{-1}$ water), thereby limiting the total FE for $CH_4$ oxidation. With increasing voltages there was a tradeoff between current density and faradaic efficiency for $HCOO^-$, decreasing from 42% at 0.9 $V_{RHE}$ to 13% at 1.2 $V_{RHE}$. On the flipside, faradic efficiency for $CO_3^{2-}$ increased from 8.3% at 0.9 $V_{RHE}$ to 41% at 1.2 $V_{RHE}$.

Further control experiment under open circuit potential (OCP) conditions, i.e., without an electrochemical bias, did not reveal any products via the 1H NMR analysis, indicating that the oxidation products detected ($HCOO^-$+$CO_2$) were directly/indirectly results of an electrochemical reaction. The $CH_4$ oxidation was also conducted without the addition of $H_2O_2$ in the OER potential window. FIG. 2D shows that at high anodic bias (≥1.8 V), $CO_2$ was the only $CH_4$ oxidation product detected (FE of 21.6% at 1.8 $V_{RHE}$). While this confirmed the possibility to oxidize $CH_4$ without the use of $H_2O_2$, it also revealed the undesirable overoxidation of $CH_4$ to $CO_2$ due to the high voltages. Upon stepping to a higher applied potential (2.6 $V_{RHE}$), the $CO_2$ FE dropped to 5.1% due to the limited availability of $CH_4$ in the electrolyte.

The harsh oxidizing conditions warranted stability testing of our CuFe/NiF catalyst. We confirmed the stability of our catalyst by chronoamperometry measurements at 0.9 $V_{RHE}$ (FIG. 2E) whereby the drop in current density was due to $H_2O_2$ consumption and the addition of the same amount of $H_2O_2$ led the current to return to its initial value, while the $HCOO^-$ faradaic efficiency remained steady at ~42%. We summarized the electrochemical performance metrics of the CuFe/NiF catalyst in a radar chart (FIG. 2F), wherein we compared our results with previously reported literature. We demonstrated a current density of ~32 mA $cm^{-2}$, at an applied potential of 0.9 $V_{RHE}$, total $eCH_4OR$ faradaic efficiency of 50.7% and a liquid oxygenate selectivity of 100%. There are only a handful of reports, wherein faradaic efficiency for $eCH_4OR$ was reported at very low current densities (μA $cm^{-2}$) and/or high applied potentials (>1.4 $V_{RHE}$).

Catalyst Characteristics

X-ray diffraction (XRD) analysis was conducted to determine the crystallinity of the CuFe/NiF electrode. The XRD pattern (FIG. 2A) shows that three large diffraction peaks at 44°, 52° and 76° are due to the (111), (200) and (220) facets of the nickel scaffold, while the ones at 30°, 35° and 37° match those for the tetragonal $CuFe_2O_4$ (JCPDS: 34-0425). However, other diffraction peaks are also present which can be assigned to CuO and $Fe_2O_3$. A previous report by Inamdar et al. confirmed that the hydrothermally grown CuFe on nickel foam at 105° C. forms a bimetallic composite of crystalline Cu matrix incorporated with Fe.[7] Our XRD data also suggests that our catalyst is a composite system of amorphous CuFe oxides and tetragonal $CuFe_2O_4$.

Figure 3:
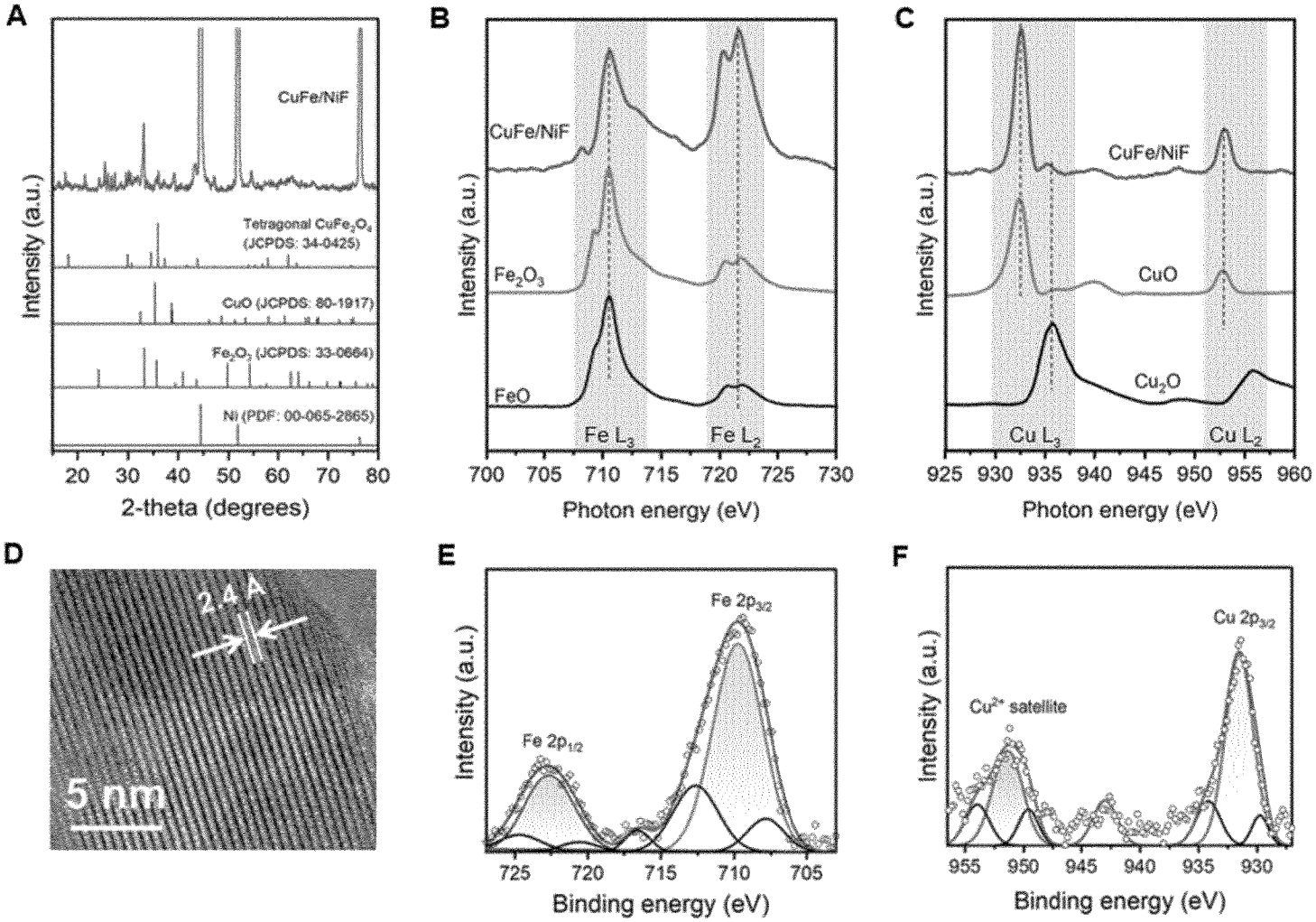
FIG. 3 Structural characterization of the catalyst. (A) XRD pattern of the CuFe/NiF in comparison with standard XRD patterns. (B) and (C) Fe $L_{3,2}$-edge and Cu $L_{3,2}$-edge of the CuFe/NiF electrode, respectively. (D) HRTEM image of the CuFe/NIF electrode. (E) and (F) Core-level spectra for Fe 2p and Cu $2p_{3/2}$ of the CuFe/NiF electrode, respectively. Black empty circles: experimental points, solid lines: fitted data.

X-ray absorption spectroscopy (XAS) was conducted to gain more understanding of the electronic and oxidation states of each element in the electrode. The XAS spectrum of the Fe $L_3$-edge presents two main peaks at 708 and 711 eV while the Fe $L_2$-edge shows peaks at 720 and 722 eV (FIG. 3B).[9] The peak at ~710 eV represents confirms the presence of both octahedral and tetrahedral sites of $Fe^{III}$ as compared with the spectrum of $Fe_2O_3$ reference. The suppression of the peak at 708 eV is attributed to the contributions from $Cu^I$ cations. The Cu $L_{3,2}$-edge spectrum of the CuFe/NiF coincide with the absorption spectrum of the CuO, which shows that copper presents mainly as $Cu^{II}$ on the electrode (FIG. 3C). However, the peak at 935 eV also signifies the existence of $Cu^I$ species.

Further, the chemical state of the CuFe/NiF electrode was studied by X-ray photoelectron spectroscopy (XPS). The high-resolution spectrum of Fe 2p in FIG. 3E reveals two peaks at 721.4 and 710.75 eV which correspond to Fe $2p_{1/2}$ and Fe $2p_{3/2}$ and spin-orbit states, respectively.[10,11] This observation confirms the presence of the $Fe^{III}$ state in the CuFe/NIF electrode. The Cu 2p spectrum in FIG. 3F shows two satellite shake-up peaks at 954.4 and 951.0 eV and two peaks at 932.6 and 931.2 eV, confirming that Cu has a combination of 1+ and 2+ oxidation states on the surface of CuFe/NiF electrode.[12,13] The core-level O 1s further confirms the presence of the metal oxides on the catalyst surface.

Field emission scanning electron microscopy (FE-SEM) images of the CuFe/NiF electrode illustrated the following characteristics. The synthesized CuFe consists of randomly interconnected compact nanoflakes covering the NiF substrate. Energy dispersive X-ray (EDX) spectroscopy proved the existence of Fe, Cu and O in the CuFe/NiF electrode with an atomic ratio for Cu/Fe at 1.65. This observation confirms that the CuFe composite is Cu-rich even though an equimolar amount of Cu and Fe precursors were used during the hydrothermal synthesis. A high-resolution transmission electron microscopy (HRTEM) image of the CuFe/NIF electrode is shown in FIG. 3D. The lattice fringes with a distance of 2.4 Å is associated with the (311) facet of $CuFe_2O_4$ while the fringes with lattice distances of 2.1 Å and 1.8 Å correspond to the (111) and (200) facets of Fe and Cu, respectively.[7,14]

Mechanistic Study of $eCH_4OR$

Figure 4:
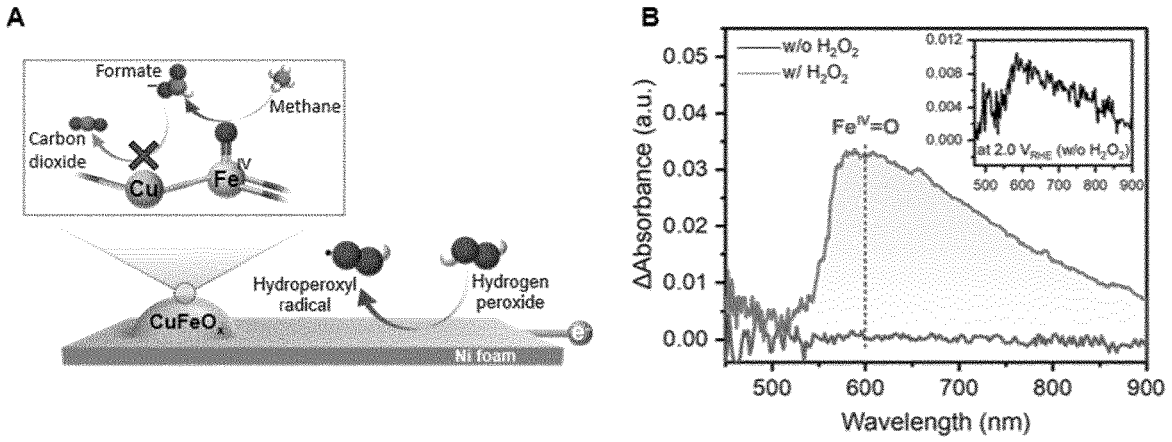
FIG. 4 Mechanistic understanding of the $eCH_4OR$. (A) Schematic of the proposed reaction mechanism of $CH_4$ oxidation on the CuFe/NiF with the use of $H_2O_2$. (B) Operando spectroelectrochemical integral absorbance of CuFe/FTO at 1.4 $V_{RHE}$ with and without the addition of 100 mM $H_2O_2$ in 1.0 M KOH (inset: integral absorbance at 2.0 $V_{RHE}$ without the addition of $H_2O_2$). The baseline was recorded under open circuit potential (OCP) conditions.

The control experiments as discussed earlier in FIG. 2A indicates that the $eCH_4OR$ only occurred in presence of iron, while the synergistic use of $H_2O_2$ and copper helped in its selective partial oxidation to formate. To further gain insights into the mechanism, the $eCH_4OR$ were conducted in an operando spectroelectrochemical setup which allowed to monitor changes in the absorption spectra as a function of applied voltage. The electrode was prepared by hydrothermally growing a thin layer of CuFe on fluorine-doped tin oxide (denoted as CuFe/FTO). At first, the experiment was performed under water oxidation reaction, without the addition of $H_2O_2$. The baseline was recorded under open circuit potential (OCP) conditions. The inset of FIG. 4B shows a broad integrated absorption (ΔAbs) band centred at 600 nm when the potential applied on the CuFe/FTO was held at 2.0 $V_{RHE}$. This peak can be assigned to the high-valent $Fe^{IV}$=O and is similar to those previously reported in the literature for the α-$Fe_2O_3$ on FTO.[6,15-17]

Upon adding $H_2O_2$, the same peak can be observed at 1.4 $V_{RHE}$ (~ 600 mV lower overpotentials) with much higher intensity (FIG. 4B). Without the use of $H_2O_2$, this peak is only observable at much higher voltages (≥1.9 $V_{RHE}$). This observation shows that the formation of the high-valent $Fe^{IV}$=O species is obtained at lower overpotentials compared to the OER.

The mechanisms of C—H bond dissociation of $CH_4$ can be classified into two categories: dehydrogenation and deprotonation. The dehydrogenation mechanism is generally observed for strong oxidizing catalysts such as high-valent metal oxo species as in the $Fe^{IV}$v=O.[20] The mechanism occurs via the surface nucleophilic oxygens, i.e., electron saturated species ($O^{2-}$), which act as $H^+$ acceptors and abstract a hydrogen atom (·H) from $CH_4$. In contrast, the deprotonation mechanism usually occurs on metal complexes with low oxidation states metal centres and accessible $H^+$ acceptors.[21] In addition to the dehydrogenation and deprotonation mechanisms, $CH_4$ oxidation could go through the Fenton pathway in which the reaction is initiated by free radicals that are accompanied by a Fenton reagent, such as $Fe^{II}$ which generates ·OH radicals. A DFT study by Szécsényi et al. have shown the existence of a combination of dehydrogenation, deprotonation, and Fenton pathways.[21] The complexity of their reaction mechanism is due to the presence of multiple oxidation states of Fe. It has been found that $Fe^{II}$ and $Fe^{III}$ favour the deprotonation and Fenton pathways, while the $Fe^{IV}$=O would promote the dehydrogenation pathway.[20] Adopting electrochemical means assure steady generation of $Fe^{IV}$ sites that can prevent unwanted competing reactions at the $Fe^{III}$ sites to take place through the Fenton pathway.[20]

These high valent $Fe^{IV}$ species detected during in situ spectroelectrochemical measurements of FIG. 4B, have been reported to be active sites for OER in alkaline conditions, using operando XAS and Mössbauer spectroscopies.[22,23] An operando infrared spectroscopy study performed by Zandi and Hamann showed that the rate-limiting step for the water oxidation is the oxidation of $Fe^{III}$—OH to $Fe^{IV}$=O.[24]

$$Fe^{III} + H_2O \rightarrow Fe^{III} - OH + H^+ \quad (1)$$

$$Fe^{III} - OH \rightarrow Fe^{IV} = O + H^+ + e^- \quad (2)$$

Therefore, even without the use of $H_2O_2$, one can generate the high-valent metal oxo $Fe^{IV}$=O species, and in return dissociate the C—H bond. However, due to the use of high voltages, there will be a competitive OER, in addition to the high possibility of the produced oxygenates being overoxidized to $CO_2$. This supports what was observed during the electrochemical tests discussed in FIG. 2D. Based on our combined experimental and mechanistic study, we can propose the following mechanism for $eCH_4OR$ using our CuFe/NiF electrode: The generation of high valent $Fe^{IV}$=O species is dependent on the availability of the reactive oxygen species whereby $H_2O_2$ would predominantly be oxidized on nickel to generate the reactive oxygen species of hydroperoxyl radicals (·OOH). The $Fe^{IV}$=O is then generated by radical addition as mentioned in Equation (4):

$$Fe^{III} + H_2O \rightarrow Fe^{III} - OH + H^+ \quad (3)$$

$$Fe^{III} - OH + \bullet OOH \rightarrow Fe^{IV} = O + O_2 + H^+ + 2e^- \quad (4)$$

Hence, $Fe^{IV}$=O would easily be formed since $H_2O_2$ oxidation happens at low applied potential compared to $H_2O$ oxidation. The copper centres will modulate the reaction environment and prevent the over-oxidation of the produced oxygenates to $CO_2$ by reducing the excess of radicals.

CONCLUSION

A route for selective partial oxidation of methane at ambient conditions is disclosed herein, which avoids unwanted overoxidation to $CO_2$. Operando potential-controlled spectroelectrochemistry showed that $Fe^{IV}$ can be obtained with the help of reactive oxygen species generated via the partial electrooxidation of $H_2O_2$ at lower overpotentials. Cu is disclosed to have a crucial role in protecting the produced liquid oxygenates from overoxidation to $CO_2$. A trimetallic catalyst of CuFeNi is provided that is demonstrated to be capable of Faradaic efficiencies of ~42% and liquid product selectivity of 100% at current densities of 32 mA $cm^{-2}$.

Although various embodiments of the invention are disclosed herein, many adaptations and modifications may be made within the scope of the invention in accordance with the common general knowledge of those skilled in this art. Such modifications include the substitution of known equivalents for any aspect of the invention in order to achieve the same result in substantially the same way. Numeric ranges are inclusive of the numbers defining the range. The word "comprising" is used herein as an open-ended term, substantially equivalent to the phrase "including, but not limited to", and the word "comprises" has a corresponding meaning. As used herein, the singular forms "a", "an" and "the" include plural referents unless the context clearly dictates otherwise. Thus, for example, reference to "a thing" includes more than one such thing.

Citation of references herein is not an admission that such references are prior art to the present invention. Any priority document(s) and all publications, including but not limited to patents and patent applications, cited in this specification are incorporated herein by reference. All documents cited or referenced in herein cited documents, together with any manufacturer's instructions, descriptions, product specifications, and product sheets for any products mentioned herein or in any document incorporated by reference herein, are hereby incorporated herein by reference, and may be employed in the practice of the invention. More specifically, all referenced documents are incorporated by reference to the same extent as if each individual publication were specifically and individually indicated to be incorporated by reference herein and as though fully set forth herein. The invention includes all embodiments and variations substantially as hereinbefore described and with reference to the examples and drawings.

REFERENCES

1. *Key World Energy Statistics* 2020. (International Energy Agency, 2020).
2. *EIA* (2019). *Levelized Cost and Levelized Avoided Cost of New Generation Resources in the Annual Energy Outlook* 2015. *Indep. Stat. Anal.*, 1-12.
3. Bagherzadeh Mostaghimi, A. H., Al-Attas, T. A., Kibria, M. G. & Siahrostami, S. A review on electrocatalytic oxidation of methane to oxygenates. *J. Mater. Chem. A* 8, 15575-15590 (2020).
4. Amenomiya, Y., Birss, V. I., Goledzinowski, M., Galuszka, J. & Sanger, A. R. Conversion of Methane by Oxidative Coupling. *Catal. Rev.* 32, 163-227 (1990).
5. Wang, V. C. C. et al. Alkane Oxidation: Methane Monooxygenases, Related Enzymes, and Their Biomimetics. *Chem. Rev.* 117, 8574-8621 (2017).
6. Takashima, T., Ishikawa, K. & Irie, H. Detection of Intermediate Species in Oxygen Evolution on Hematite Electrodes Using Spectroelectrochemical Measurements. *J. Phys. Chem. C* 120, 24827-24834 (2016).
7. Inamdar, A. I. et al. A Robust Nonprecious CuFe Composite as a Highly Efficient Bifunctional Catalyst for Overall Electrochemical Water Splitting. *Small* 16, (2020).
8. Ding, K. et al. Pt—Ni bimetallic composite nanocatalysts prepared by using multi-walled carbon nanotubes as reductants for ethanol oxidation reaction. *Int. J. Hydrogen Energy* 39, 17622-17633 (2014).
9. Indra, A. et al. Unification of catalytic water oxidation and oxygen reduction reactions: Amorphous beat crystalline cobalt iron oxides. *J. Am. Chem. Soc.* 136, 17530-17536 (2014).
10. Sahasrabudhe, A., Dixit, H., Majee, R. & Bhattacharyya, S. Value added transformation of ubiquitous substrates into highly efficient and flexible electrodes for water splitting. *Nat. Commun.* 9, (2018).

11. Yamashita, T. & Hayes, P. Analysis of XPS spectra of Fe 2+ and Fe 3+ ions in oxide materials. *Appl. Surf. Sci.* 254, 2441-2449 (2008).
12. Karthikeyan, S. et al. Cu and Fe oxides dispersed on SBA-15: A Fenton type bimetallic catalyst for N,N-diethyl-p-phenyl diamine degradation. *Appl. Catal. B Environ.* 199, 323-330 (2016).
13. Faheem, M., Jiang, X., Wang, L. & Shen, J. Synthesis of Cu2O—CuFe2O4 microparticles from Fenton sludge and its application in the Fenton process: The key role of Cu2O in the catalytic degradation of phenol. *RSC Adv.* 8, 5740-5748 (2018).
14. Xia, C., Yoon, J., Kim, T. & Wang, H. Recommended practice to report selectivity in. *Nat. Catal.* 3, 605-607 (2020).
15. Le Formal, F. et al. Rate Law Analysis of Water Oxidation on a Hematite Surface. *J. Am. Chem. Soc.* 137, 6629-6637 (2015).
16. Kamiya, K., Kuwabara, A., Harada, T. & Nakanishi, S. Electrochemical Formation of Fe(IV)=O Derived from $H_2O_2$ on a Hematite Electrode as an Active Catalytic Site for Selective Hydrocarbon Oxidation Reactions. *ChemPhysChem* 20, 648-650 (2019).
17. Klahr, B. & Hamann, T. Water oxidation on hematite photoelectrodes: Insight into the nature of surface states through in situ spectroelectrochemistry. *J. Phys. Chem. C* 118, 10393-10399 (2014).
18. Liu, Y. et al. Insights into the interfacial carrier behaviour of copper ferrite (CuFe 2 O 4) photoanodes for solar water oxidation. *J. Mater. Chem. A* 7, 1669-1677 (2019).
19. Takashima, T., Yamaguchi, A., Hashimoto, K., Irie, H. & Nakamura, R. In situ UV-vis Absorption Spectra of Intermediate Species for Oxygen-Evolution Reaction on the Surface of MnO2 in Neutral and Alkaline Media. *Electrochemistry* 82, 325-327 (2014).
20. Yuan, S. et al. Conversion of Methane into Liquid Fuels—Bridging Thermal Catalysis with Electrocatalysis. *Adv. Energy Mater.* 10, 1-19 (2020).
21. Szécsényi, A., Li, G., Gascon, J. & Pidko, E. A. Mechanistic Complexity of Methane Oxidation with H2O2 by Single-Site Fe/ZSM-5 Catalyst. *ACS Catal.* 8, 7961-7972 (2018).
22. Wang, D. et al. In Situ X-ray Absorption Near-Edge Structure Study of Advanced NiFe(OH)x Electrocatalyst on Carbon Paper for Water Oxidation. *J. Phys. Chem. C* 119, 19573-19583 (2015).
23. Chen, J. Y. C. et al. Operando Analysis of NiFe and Fe Oxyhydroxide Electrocatalysts for Water Oxidation: Detection of Fe4+ by Mössbauer Spectroscopy. *J. Am. Chem. Soc.* 137, 15090-15093 (2015).
24. Zandi, O. & Hamann, T. W. Determination of photoelectrochemical water oxidation intermediates on haematite electrode surfaces using operando infrared spectroscopy. *Nat. Chem.* 8, 778-783 (2016).
25. Kim, H. W. et al. Efficient hydrogen peroxide generation using reduced graphene oxide-based oxygen reduction electrocatalysts. *Nat. Catal.* 1, 282-290 (2018).
26. Han, G. F. et al. Building and identifying highly active oxygenated groups in carbon materials for oxygen reduction to H2O2. *Nat. Commun.* 11, (2020).
27. Lu, Z. et al. High-efficiency oxygen reduction to hydrogen peroxide catalysed by oxidized carbon materials. *Nat. Catal.* 1, 156-162 (2018).
28. Sa, Y. J., Kim, J. H. & Joo, S. H. Active Edge-Site-Rich Carbon Nanocatalysts with Enhanced Electron Transfer for Efficient Electrochemical Hydrogen Peroxide Production. *Angew. Chemie—Int. Ed.* 58, 1100-1105 (2019).
29. Assumpção, M. H. M. T. et al. A comparative study of the electrogeneration of hydrogen peroxide using Vulcan and Printex carbon supports. *Carbon N. Y.* 49, 2842-2851 (2011).
30. Barros, W. R. P., Ereno, T., Tavares, A. C. & Lanza, M. R. V. In Situ Electrochemical Generation of Hydrogen Peroxide in Alkaline Aqueous Solution by using an Unmodified Gas Diffusion Electrode. *ChemElectroChem* 2, 714-719 (2015).
31. Guo, Y. et al. Electrocatalytic reduction of CO2 to CO with 100% faradaic efficiency by using pyrolyzed zeolitic imidazolate frameworks supported on carbon nanotube networks. *J. Mater. Chem.* A 5, 24867-24873 (2017).
32. Yi, Y. et al. Electrochemical corrosion of a glassy carbon electrode. *Catal. Today* 295, 32-40 (2017).
33. Weissmann, M., Baranton, S., Clacens, J. M. & Coutanceau, C. Modification of hydrophobic/hydrophilic properties of Vulcan XC72 carbon powder by grafting of trifluoromethylphenyl and phenylsulfonic acid groups. *Carbon N. Y.* 48, 2755-2764 (2010).
34. Li, L. et al. Tailoring Selectivity of Electrochemical Hydrogen Peroxide Generation by Tunable Pyrrolic-Nitrogen-Carbon. *Adv. Energy Mater.* 10, 1-10 (2020).
35. Nagaiah, T. C., Kundu, S., Bron, M., Muhler, M. & Schuhmann, W. Nitrogen-doped carbon nanotubes as a cathode catalyst for the oxygen reduction reaction in alkaline medium. *Electrochem. commun.* 12, 338-341 (2010).
36. Ellison, M. D., Crotty, M. J., Koh, D., Spray, R. L. & Tate, K. E. Adsorption of NH 3 and NO 2 on single-walled carbon nanotubes. *J. Phys. Chem. B* 108, 7938-7943 (2004).
37. Brillas, E., Alcaide, F. & Cabot, P. L. A small-scale flow alkaline fuel cell for on-site production of hydrogen peroxide. *Electrochim. Acta* 48, 331-340 (2002).
38. Merle, G., Wessling, M. & Nijmeijer, K. Anion exchange membranes for alkaline fuel cells: A review. *J. Memb. Sci.* 377, 1-35 (2011).
39. Salvatore, D. A. et al. Designing anion exchange membranes for CO2 electrolysers. *Nat. Energy* (2021) doi: 10.1038/s41560-20-00761-x.

The invention claimed is:

1. A method for electrochemically oxidizing methane to formate, comprising, in an electrolytic cell:

providing a methane supply to an alkaline aqueous anolyte medium comprising hydroperoxyl anions, wherein the alkaline aqueous anolyte medium is in contact with an oxidation catalyst anode, wherein the oxidation catalyst anode comprises CuFe oxide catalytic centres supported on a nickel substrate; and, supplying an anodic current to the oxidation catalyst anode in the alkaline aqueous anolyte medium, to electrolytically oxidize methane to formate in an anodic oxidation reaction.

2. The method of claim 1, wherein the nickel substrate is a nickel foam substrate.

3. The method of claim 1, wherein the anodic oxidation reaction is carried out at Faradaic efficiencies of at least 40%.

4. The method of claim 1, wherein the anodic oxidation reaction is carried out at a formate liquid product selectivity of at least 90%, optionally at least 99%.

5. The method of claim 1, wherein the anodic oxidation reaction is carried out at current densities of at least 30 mA $cm^{-2}$.

6. The method of claim 1, wherein electrolytic oxidation of methane to formate in the anodic oxidation reaction is carried out under ambient conditions.

7. The method of claim 1, wherein electrolytic oxidation of methane to formate in the anodic oxidation reaction is carried out at a temperature of 5° C. to 45° C. and/or a pressure of 50-115 kPa.

* * * * *